United States Patent [19]

Durenec

[11] 4,412,423

[45] Nov. 1, 1983

[54] SPLIT-CYCLE COOLER WITH IMPROVED PNEUMATICALLY-DRIVEN COOLING HEAD

[75] Inventor: Peter Durenec, Annandale, Va.

[73] Assignee: The United States of America as represented by the Secretary of the Army, Washington, D.C.

[21] Appl. No.: 388,766

[22] Filed: Jun. 16, 1982

[51] Int. Cl.[3] ..... F25B 9/00

[52] U.S. Cl. ..... 62/6; 60/520

[58] Field of Search ..... 62/6, 560

[56] References Cited

U.S. PATENT DOCUMENTS

| | | | |
|---|---|---|---|
| 4,090,858 | 5/1978 | Hanson | 62/6 |
| 4,235,078 | 11/1980 | Morbidi | 62/6 |
| 4,277,948 | 7/1981 | Horn et al. | 62/6 |

*Primary Examiner*—Ronald C. Capossela

*Attorney, Agent, or Firm*—Robert P. Gibson; Milton W. Lee; Aubrey J. Dunn

[57] ABSTRACT

A pneumatic space and an expansion space are provided in a cooling head having a double-ended piston. A fluid line from the cooler compressor feeds directly into the expansion space, and, via a fluid delay, into the pressure space. In response to the fluid pressure waves in the lines, the piston is first moved in one direction by fluid in the expansion space and in the opposite direction by fluid in the pneumatic space.

2 Claims, 1 Drawing Figure

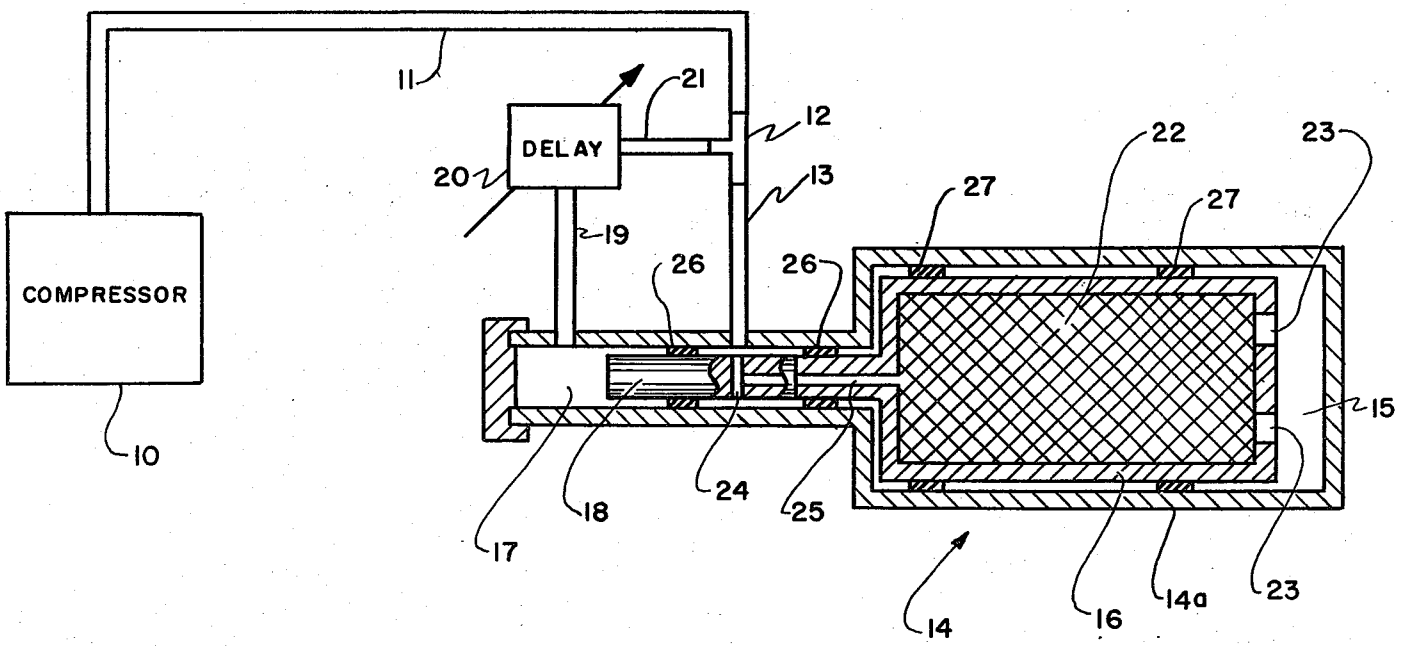
COMPRESSOR
DELAY
10
11
12
13
14
14a
15
16
17
18
19
20
21
22
23
23
24
25
26
26
27
27

SPLIT-CYCLE COOLER WITH IMPROVED PNEUMATICALLY-DRIVEN COOLING HEAD

The invention described herein may be manufactured, used and licensed by the U.S. Government for governmental purposes without the payment of any royalties thereon.

BACKGROUND OF THE INVENTION

This invention is in the field of mechanical cryogenic coolers, such as those using the Stirling cycle, and is particularly concerned with those coolers using a so-called split cycle. A good discussion of cryogenic refrigerators, including split cycle, appears in U.S. Pat. No. 3,630,041 of Dec. 28, 1971 to Danials et al. The split cycle refrigerator disclosed by Danials et al uses separate electrical motors for moving the hot and cold displacers. A more recent version of split cycle uses a pneumatically driven (free piston) cold displacers, as shown in U.S. Pat. No. 3,877,239 of Apr. 15, 1975 to Leo. An even more recent split cycle cooler is U.S. Pat. No. 4,092,833 of June 6, 1978 to Durenec. The problem exists in pneumatically driven cold displacers of what technique to employ in order to obtain a reliable and efficient return stroke for the cold displacer. The above-cited patents to Leo and Durenec respectively use a pneumatic spring and another compressor piston connected by another fluid line to the equivalent of Leo's pneumatic spring. Another technique for obtaining cold displacer return uses a pneumatic return cylinder with a seal having a controlled leakage from the displacer cylinder. All of these free piston systems have disadvantages compared to the instant invention. For example, the last mentioned technique above will vary in cylinder return timing as its seals undergo normal wear. Since the cited Durenec patent was issued, it has been found that a phase angle other than 180° between pressure waves (spaces 19 and 20) in more desirable. In the cited Leo patent, seal wear will change piston timing. The instant invention is mechanically simpler than the Danials et al and the Durenec patents and allows for adjustment of displace piston timing after the device is assembled.

SUMMARY OF THE INVENTION

The invention is a split cycle mechanical cooler with a free displacer piston coupled to a pneumatic return bounce piston. The displacer piston is moved by a wave of pressure from a compressor piston through a fluid conduit and is returned by a delayed portion of the pressure wave acting on the pneumatic piston.

BRIEF DESCRIPTION OF THE DRAWINGS

The single drawing FIGURE shows a partly schematic, partly sectional view of invention.

DESCRIPTION OF PREFERRED EMBODIMENT

The invention might be best understood when this description is taken in conjunction with the drawing. Reference numeral 10 of the drawing designates a motor-driven compressor which might be similar to the compressor shown in the patent to Leo cited above; the particular details of the compressor, per se, are not critical to the instant invention. Connected to 10 is one end of cryogenic fluid conduit 11. The other end of 11 is connected to T-connection 12. Also connected to 12 is conduit 13 with its opposite end connected to displacer piston assembly generally designated 14 and having housing 14*a*. Space 15 in 14 is the expansion space for displacer piston 16 and space 17 is the pneumatic space for pneumatic piston 18 attached to 16. Space 17 is connected by fluid conduit 19 to adjustable fluidic delay device 20. Device 20 is connected to T-connection 12 by conduit 21. Displacer piston 16 is substantially the same as piston 21 in U.S. Pat. No. 4,092,833 referred to above; 16 is hollow and is filled with regenerator material 22, and has openings 23 corresponding to openings 22*b* of the patent. Fluid access to the interior of 16 is via bores 24 and 25; seals 26 and 27 guide and seal 16 inside housing 14*a*. As is usual with this type of cooler, the fluid passageways, conduits, cylinders, etc. are filled with a cryogenic fluid in gaseous form.

Delay 20 is a fluidic resistance-capacitance network, well known in the art, wherein either the resistance (orifice size) or capacitance (volume) may be varied. Whenever compressor 10 supplies a pressure wave to conduit 11, this wave is fed into conduits 13 and 21 such that the wave applied to piston 18 is delayed with respect to the way admitted to displacer piston 16. The minimum angle between the two waves is 45°, and the maximum is 90°. The angle may be predetermined from the physical constants of the cooler and 20 may be preset to provide this angle, or the angle may be manually set while the cooler is operation, to achieve maximum cooling.

I claim:

1. A split-cycle cryogenic cooler system including a compressor which provides a pressure wave in said system, a displacer piston assembling, a cryogenic fluid conduit means between said compressor and said assembly, with a cryogenic fluid in said compressor, said assembly, and said conduit means, wherein the improvement comprise:

said displacer piston assembly has an expansion space and pneumatic space in communication with said fluid conduit means, wherein said fluid conduit means includes:

first and second fluid conduits respectively connected to said expansion space and to said pneumatic space to conduct respectively first and second portions of said pressure wave;

a fluidic delay in said first fluid conduit whereby said first portion of said pressure wave leads in time or phase the second portion of said pressure wave.

2. The system as defined in claim 1 wherein said displacer piston assembly has a double-ended piston therein, with one end in said pneumatic space and the other end in said expansion space.

* * * * *